US005078032A

United States Patent [19]

Gerlach

[11] Patent Number: 5,078,032

[45] Date of Patent: Jan. 7, 1992

[54] DEVICE FOR CUTTING WIRE

[75] Inventor: Hans-Juergen Gerlach, Herborn-Merkenbach, Fed. Rep. of Germany

[73] Assignee: Berkenhoff GmbH, Heuchelheim, Fed. Rep. of Germany

[21] Appl. No.: 578,899

[22] Filed: Sep. 7, 1990

[30] Foreign Application Priority Data

Aug. 8, 1987 [DE] Fed. Rep. of Germany ....G8910748

[51] Int. Cl.[5] ..... B26D 1/12

[52] U.S. Cl. ..... 83/167; 83/370; 83/422; 83/591; 83/950

[58] Field of Search ..... 83/950, 949, 907, 167, 83/422, 591, 663, 370, 909, 913, 402, 321, 329, 330, 679

[56] References Cited

U.S. PATENT DOCUMENTS

| | | | |
|---|---|---|---|
| 2,217,766 | 10/1940 | Neff | 83/402 |
| 2,745,490 | 5/1956 | Steiger et al. | 83/591 X |
| 3,119,294 | 1/1964 | Billingsley et al. | 83/402 X |
| 3,526,232 | 9/1970 | Dearsley | 83/370 X |
| 3,768,353 | 10/1973 | Milner | 83/402 X |
| 3,776,076 | 12/1973 | Hauck | 83/370 X |
| 3,854,356 | 12/1974 | Okreglak | 83/370 X |
| 4,043,238 | 8/1977 | van Ham | 83/663 X |
| 4,283,979 | 8/1981 | Rakocy et al. | 83/591 X |

*Primary Examiner*—Mark Rosenbaum
*Assistant Examiner*—Rinaldi Rada
*Attorney, Agent, or Firm*—Flynn, Thiel, Boutell, & Tanis

[57] ABSTRACT

A device for cutting wire which includes at least one rotating knife supported on a rotating knife carrier and a counter-tool. The counter-tool includes a cutting blade rotating about a vertical first axis and having a central opening therethrough and adapted to receive the wire to be cut therethrough. The knife carrier is rotatingly supported about a second axis which is parallel with respect to the first axis, and the knife is guided along the cutting blade past the central opening to cut the wire thereat.

13 Claims, 5 Drawing Sheets

DEVICE FOR CUTTING WIRE

FIELD OF THE INVENTION

The invention relates to a device for cutting wire comprising at least one rotating knife supported on a rotating knife carrier and a counter-tool.

BACKGROUND OF THE INVENTION

A device for cutting wire is known from EP B1-0 210 482. The device is used in particular to cut the wire material exiting from a spark-erosion machine to specific lengths in order to collect the wire representing a waste product and in order to be able to feed the wire for further processing. The known device includes a cutting tool having knives arranged on its periphery, which cutting tool can engage an annular counter-tool. The wire is guided between the two tools and is pinched by the action of the cutting tool and the counter-tool. This results in a deformation of the wire and in the respective wire end piece being torn off. The disadvantage of this device is that, on the one hand, by pinching the wire a complete separation is not always assured so that the individual wire pieces still hang together and that, on the other hand, the areas of separation are irregularly constructed and prevent a compact as possible packing in a receiving receptacle.

The wire is in other known eroding machines introduced into a container and compressed from time to time. This operation requires, on the one hand, greater use of high-tech equipment for compressing the wire and is, on the other hand, susceptible to breakdown since a very compact packing of the wire cannot be accomplished and thus wire areas can result in a loop-like maze.

DE-PS 36 31 888 shows a device for cutting wire, in which a first knife member is arranged stationarily, while a counter-knife is swingingly moved back and forth past a through opening in the knife member. The wire areas to be cut off are in this device deformed because of the action of the counter-knife so that they cannot be collected in a most compact packing in a receiving receptacle. Furthermore, two cutting directions are defined, caused by the swinging back and forth movement of the counter-knife, which directions result in different wire-throwing paths, so that the cut-off wire segments must be caught in a very large catching receptacle. Furthermore, the stepping speed is limited due to the mass of the counter-knife so that this device can only be utilized with relatively slow running eroding machines. A further disadvantage is that the wire can only be threaded manually, which is relatively difficult since the wire must be deflected in the device. A further disadvantage exists due to the relatively great wear of the cutting edges of the counter-knife which cannot be reset or reground.

The basic purpose of the invention is to provide a device of the above-mentioned type, which with a simple design and simple operation enables a reliable cutting of a wire, with which the wire sections can be collected in a most compact packing or position and which can be adjusted to the most different wire-conveying speeds.

SUMMARY OF THE INVENTION

The purpose is attained according to the invention by the counter-tool being designed like a cutting blade rotating about a vertical first axis and provided with a center recess and by the knife carrier being rotatably supported about a second axis parallel to the first axis and the knife being guided along the cutting blade.

The device of the invention is distinguished by a number of significant advantages. Since the counter-tool is designed like a rotating cutting blade, it is always assured on the one hand that, due to the centrifugal force, the wire rests against the outer edge of the center recess so that a clean cut occurs upon an action of the knife. A further advantage of the cutting blade is that it has a cutting edge over its entire periphery, namely, over the entire edge of the center recess, so that as a whole wear, caused by the great length of the cutting edge, can be reduced, so that a longer life results for the cutting blade. Since furthermore the knife carrier guides the knife along the cutting blade, a clean cut with a straight, exact cutting edge is possible, and pinchings or deformations of the cut area of the wire can be completely avoided.

Thus, the device of the invention is suited for use with a wire-eroding machine since it is possible to cut the wire utilized for the cutting operation and exiting from the machine into short wire sections and to store same very compactly, so that altogether a storage container having a very small volume is needed. A further advantage is that the exiting direction of the wire ends is arranged vertically so that they can be guided without any problems into a catching container or a receiving apparatus. The risk that individual wire sections leave the device in an uncontrolled manner and are dropped outside of the receiving apparatus is thus completely eliminated.

A favorable further development of the invention provides that a guide mechanism for guiding a wire from a horizontal into a vertical conveying direction is arranged in front of the cutting blade. This design is in particular advantageous when the wire exiting from the eroding machine leaves the machine in a horizontal direction as this is common in the known machines. Additional guide mechanisms or the like are thus not needed. This design therefore also simplifies the introduction of a wire, for example after a tearing of the wire, into the eroding machine since the wire need not in addition be guided through special guide mechanisms or the like.

It is furthermore advantageous according to the invention when the guide mechanism is constructed like a belt conveyor since the belt conveyor on the one hand has a simple design and can easily be operated and on the other hand a safe guiding of the wire is guaranteed. Furthermore, the wire can be inserted in a particularly simple manner. In order to assure a safe introduction of the wire into the guide mechanism, it is advantageous when, in relationship to the conveying direction of the wire, a funnel guide is arranged in front of the guide mechanism. The funnel guide can advantageously have a wire sensor to assure that the device for the wire cutting is started only when an eroding wire extends through the device.

The device of the invention is particularly suited for a simple control and adaptation to each wire conveying speed of the eroding machine. Thus, it is possible according to the invention to control a first driving mechanism for the guide mechanism and a second driving mechanism for the knife member and the cutting blade in dependency of the signals of the wire sensors or in dependency of a tension determined by the guide mechanism. The device of the invention can thus be variably adjusted to the respective operating conditions. With respect to a tension control, it is for example possible to adjust the operating speed of the device through a current control of the driving motors.

The wire sensor, which is connected in front of the guide mechanism can, for example, be designed as proximity sensor in order to determine the approach of a wire element so that the device of the invention can be turned off in the case of a wire tear or the like. Furthermore, the device is automatically turned on when a wire is supposed to be inserted.

In order to assure an operatively safe movement of the knife, it is advantageous when the knife carrier is provided with at least one arm, at the end area of which the knife is arranged. Thus, cut-off wire pieces are prevented from being thrown against center areas of the knife carrier or being caught in areas.

A particularly favorable development of the invention provides that the knife carrier includes four cross-shaped arranged arms each with one knife so that altogether the rotational speed of the knife carrier can be reduced since several arms per rotation can engage the cutting blade.

In order to simplify a transfer of the wire from the guide mechanism into the cutting blade, it can be advantageous when a guide element rotatable with the cutting blade and having a funnel-shaped recess is arranged between the guide mechanism and the cutting blade.

Since the wire material discharged from the eroding machine is usually not voltage free, it is particularly advantageous when the device is electrically insulated so that eroding operations on the cutting tools can be avoided. The wire-guiding parts of the device are advantageously electrically insulated.

It is furthermore favorable to arrange a receiving apparatus with a shaker after the knife carrier in order to store the collected cut-off wire ends as closely together as possible.

BRIEF DESCRIPTION OF THE DRAWINGS

The invention will be described hereinafter in connection with one exemplary embodiment and the drawings, in which.

DETAILED DESCRIPTION

Figure 4:
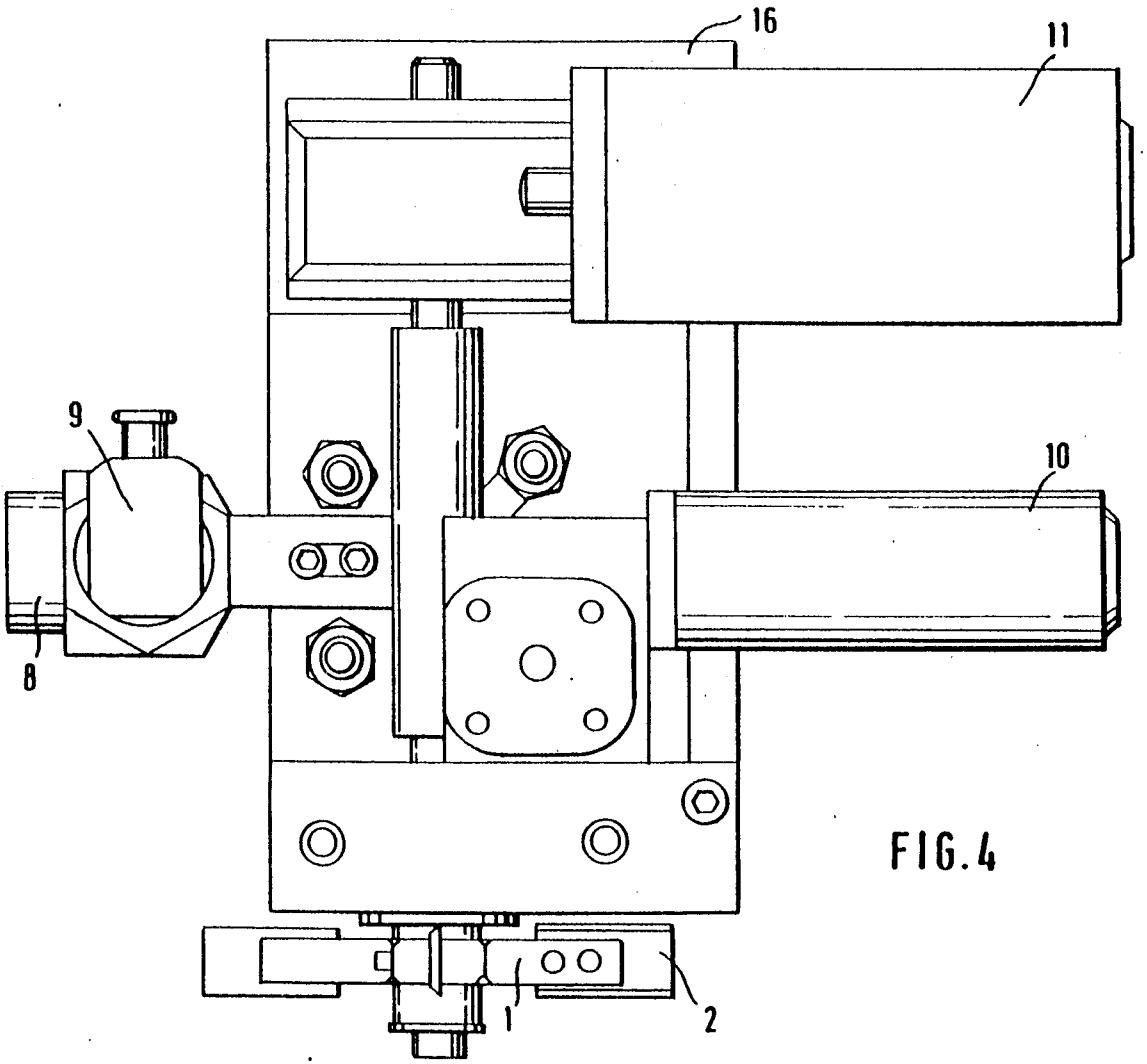
FIG. 4 is a rear view of the device of the invention.
Figure 5:
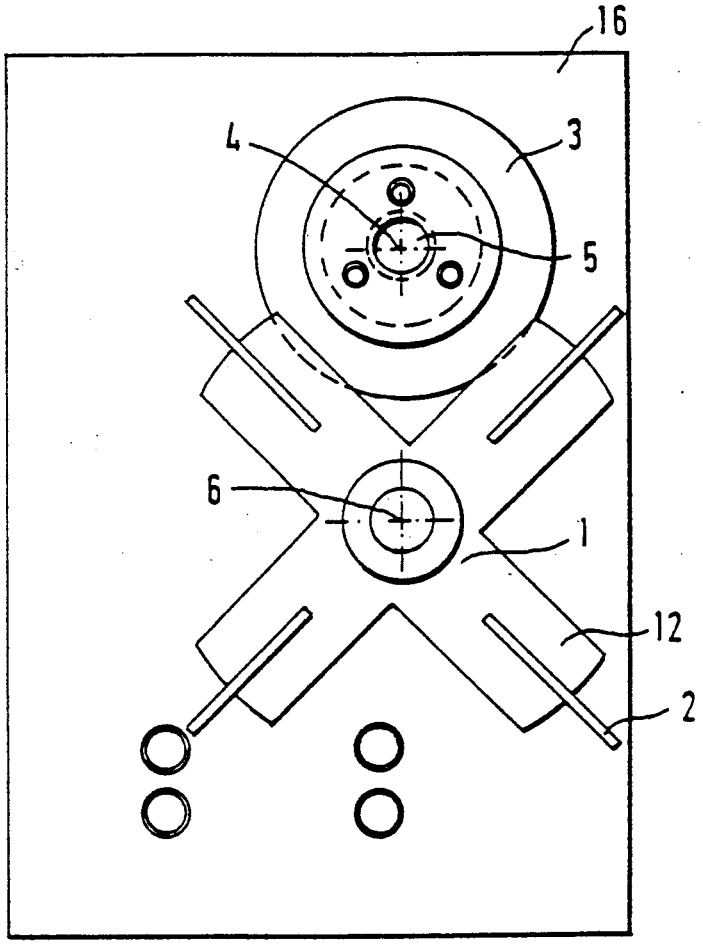
FIG. 5 is a bottom view of the device looking at the knife carrier and the cutting blade.

The device of the invention includes a housing 16 and a carrier, on the underside of which is rotatably supported a knife carrier 1 (FIGS. 4, 5) with several knives 2 fastened thereon. The knife carrier 1 in the illustrated exemplary embodiment includes four knives 2 supported on the ends of four cross-shaped arms 12.

Figure 1:
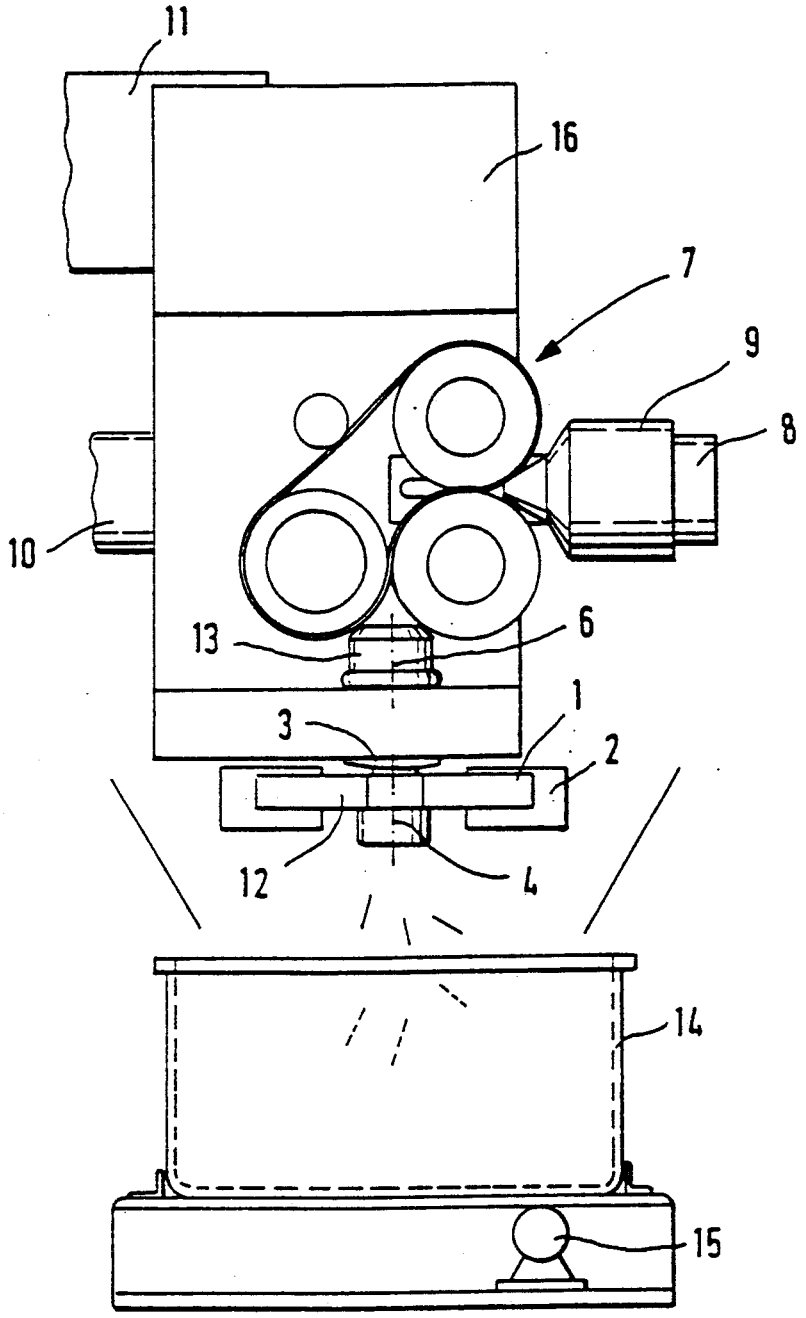
FIG. 1 is a side view of the device of the invention.

The knife carrier 1 is mounted rotatably about a second vertical axis 6 on the housing 16. Also on the underside or the lower area of the housing 16 is rotatably supported a tubular cutting blade 3 having a central opening 5 therethrough. The tubular cutting blade 3 is rotatable about a first vertical axis 4. The two axes 4 and 6 are arranged parallel to one another and at a distance from one another, as this can be seen for example in FIG. 5. Upon a rotation of the knife carrier 1, the knife 2 thus moves over the underside of the tubular cutting blade 3 so that wire material moving through the central opening 5 is cut off. Since the central opening 5 is freely accessible from the underside, the separated wire ends can fall without any problem out downwardly in order to be collected in a receiving apparatus 14 mounted on top of a vibrator mechanism 15 (see FIG. 1).

Figure 3:
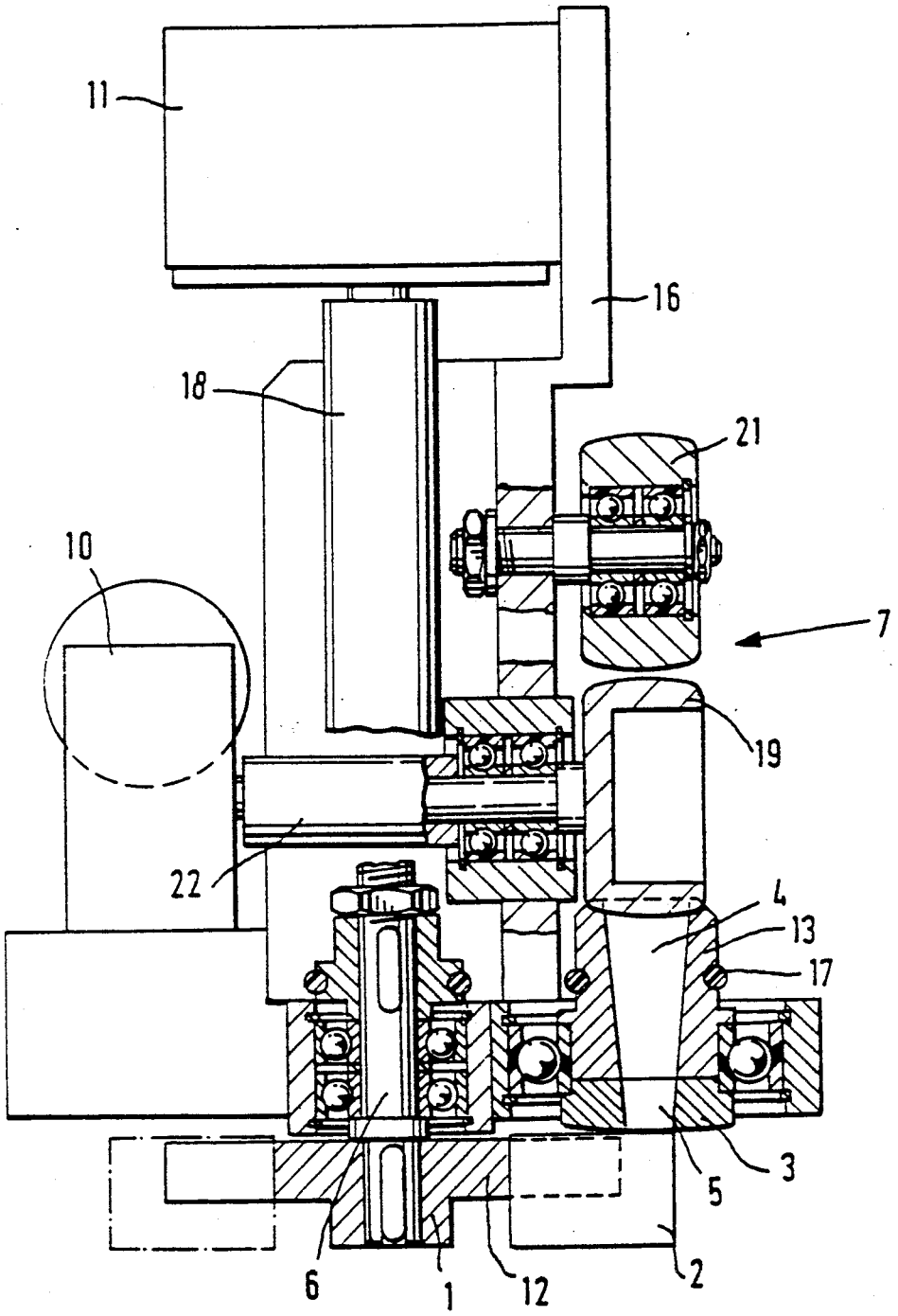
FIG. 3 is a cross-sectional view taken along the line III—III of FIG. 2.

The parallel arrangement of the two vertical axes 4, 6 can in particular be seen in FIG. 3. Also the illustration according to FIG. 3 shows that the tubular cutting blade 3 and the knife carrier 1 are coupled with respect to their movement with one another by means of a driving belt 17 or a suitable driving mechanism. The knife carrier 1 is rotatably driven by a second driving mechanism 11 which is connected to the knife carrier 1 through a shaft 18 driven by the second driving mechanism 11.

As can be seen in the illustration of FIG. 3, the tubular cutting blade 3 has a spherical or convex shape in its lower outlet end, which shape makes passing over easier for the knives 2.

The knives 2 can be adjustably arranged on the knife carrier 1 in order to be able to compensate for wear.

Figure 2:
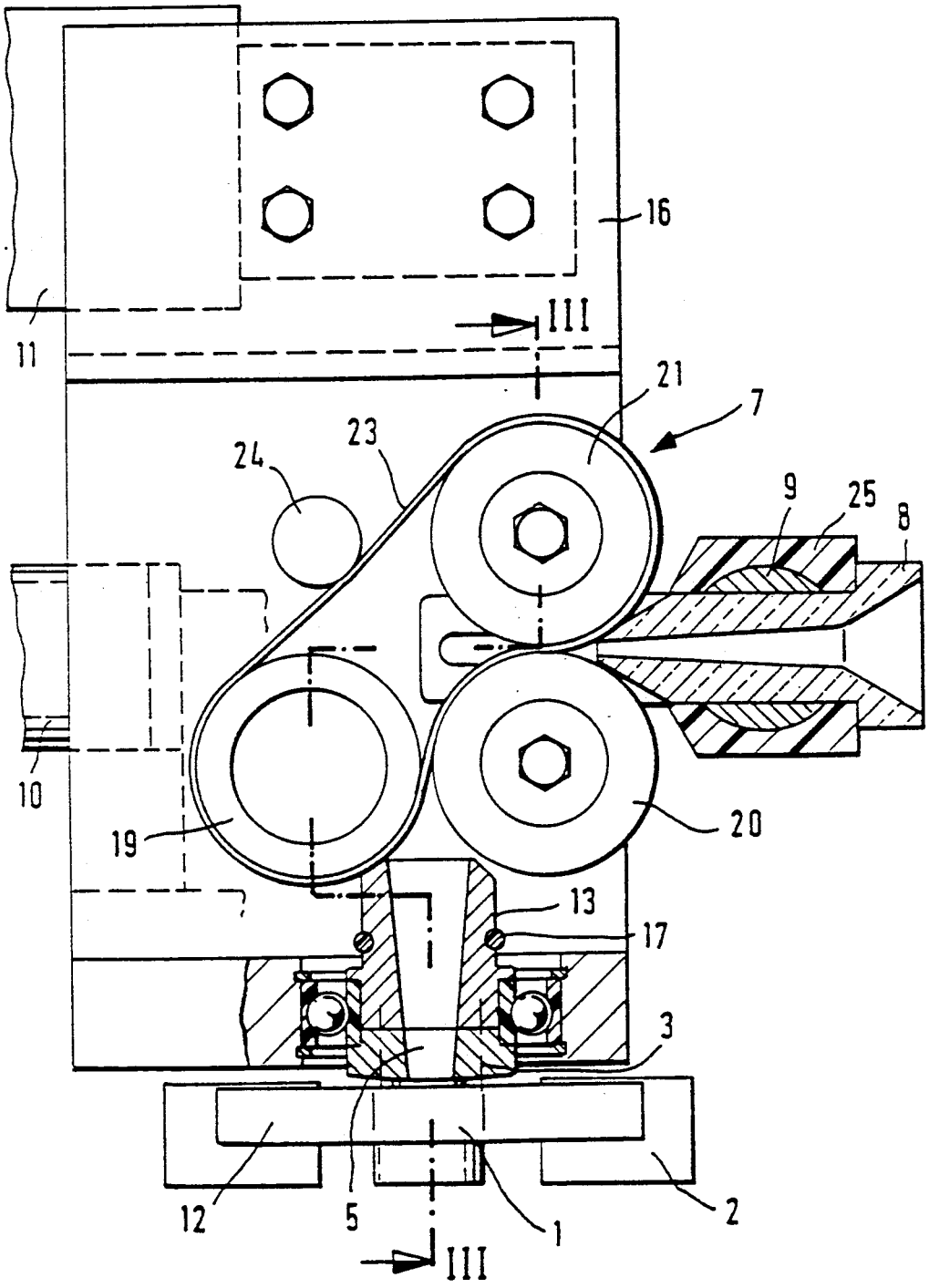
FIG. 2 is a partially cross-sectioned side view of a detail of the arrangement illustrated in FIG. 1.

The tubular cutting blade 3 is, in the illustrated exemplary embodiment, connected in one piece with the guide element 13 having a funnel-shaped opening therethrough enabling an easier introduction of the wire material as illustrated in FIG. 2.

The device of the invention includes furthermore a guide mechanism 7 including a drive roller 19 drivable through a first driving mechanism 10. The illustration according to FIG. 3 shows that the driving roller or pulley 19 is connected to a shaft 22 for this purpose. The shaft is operatively connected in a suitable manner to the driving mechanism 10. A pressure pulley 20 and a further roller or pulley 21 are furthermore provided. A belt 23 loops around the roller 21 and the driving roller 19, which belt 23 is guided on the outer periphery of the pressure pulley 20 and can be tensioned by means of a tension roller 24. A funnel guide 8 exists in the area between the roller 21 and the pressure pulley 20, through which funnel guide the wire material can be placed between the pressure pulley 20 and the belt 23.

A wire sensor 9 is furthermore provided in the area of the guide funnel 8, which wire sensor is held on the funnel guide 8 by means of a clamping mechanism 25. It is possible by means of the wire sensor 9 to determine whether a wire extends through the guide funnel 8.

The guide mechanism 7 is used to divert the horizontally arriving wire material into a vertical direction.

It is possible in the exemplary embodiment of the invention to adjust the speed of the knife in such a manner that wire pieces having a constant wire length are always cut. The adjustment can be coupled with the tension or the like determined by the guide mechanism so that a suitable association exists at all times. The device is turned on or off either using the wire sensor 9 or using the tensile stress of the eroding wire, which tensile stress is determined by the guide mechanism 7. Thus, the device of the invention turns off automatically during standstill of the erosion machine and starts to operate automatically when it is turned on. The wire sensor 9 is used in particular to determine if a tear exists in the wire, since it is designed as a proximity sensor determining a contact of the wire on the wall of the funnel of the guide funnel 8.

The device of the invention is designed such that no wire segments remain in the device, in particular not in the case of a tear in the wire. A further advantage of the device is that the wire lengths can be adjusted and can be maintained constant independently from the running speed of the eroding machine, since the speed of rotation of the knife carrier 1 and of the tubular cutting blade 3 are independent from the conveying speed of the guide mechanism 7.

The central opening 5 and the cutting edge realized thereon assure that the cutting of the wire pieces is done at all times at a right angle in a clean cutting line. Pinchings and the like thus are impossible.

The guide mechanism of the invention furthermore makes it possible to stop the device during a standstill of the erosion machine without influencing the tension of the wire. It is furthermore possible to introduce the wire in a particularly simple manner into the device so that in particular when the erosion machine is newly loaded complicated manual adjustments are not needed.

The simple design of the device of the invention enables its use with many different types of wire-eroding machines so that a universal use is created.

In conclusion the following is to be said:

The invention relates to a device for the cutting of wire including at least one rotating knife 2 supported on a rotating knife carrier 1. In order to guarantee a clean cut of the passing wire during a safe operation, it is provided that a counter-tool is designed in the form of a tubular cutting blade rotating about a vertical axis and having a central opening 5 therethrough and that the knife carrier 1 is supported rotatingly about a second axis 6 parallel to the first axis 4 and the knife 2 is guided along the lower outlet end of the tubular cutting blade 3. The device can be adjusted to different conveying speeds of the wire and permits in every instance an exact division of the wire into equal wire segments (FIG. 3).

The embodiments of the invention in which an exclusive property or privilege is claimed are defined as follows:

1. In a device for cutting wire which includes at least one knife supported on a rotating knife carrier and a counter-tool, the improvement wherein said counter-tool includes a tubular cutting blade rotating about a vertical first axis and having means for defining a central opening therethrough, said opening being adapted to receive the wire to be cut therethrough, and wherein said knife carrier is rotatingly supported about a second axis which is parallel with respect to the first axis, and said knife is guided past an outlet end of said tubular cutting blade and past said central opening to cut the wire thereat.

2. The device according to claim 1, wherein a guide mechanism for guiding a wire from a horizontal inlet direction into a vertical conveying outlet direction is arranged adjacent an inlet end of said tubular cutting blade.

3. The device according to claim 2, wherein the guide mechanism includes an endless belt movably supported on pulleys therefor for engaging the wire.

4. The device according to claim 2, wherein a guide funnel is arranged adjacent said guide mechanism on a side thereof remote from said tubular cutting blade.

5. The device according to claim 4, wherein said guide funnel includes wire sensor means for detecting the presence or absence of wire in said guide funnel.

6. The device according to claim 5, wherein said guide mechanism includes an endless belt movably supported on pulleys therefor for engaging the wire, wherein said guide mechanism includes a first driving mechanism for drivingly moving said belt for urging the wire toward an inlet end of said tubular cutting blade, and wherein said knife carrier includes a second driving mechanism for drivingly rotating said knife carrier, and wherein further means are provided for drivingly rotating said tubular cutting blade means in dependency of the presence of wire in said guide funnel detected by said wire sensor means.

7. The device according to claim 5, wherein the wire sensor means is a proximity sensor capable of detecting the presence or absence of wire in said guide funnel.

8. The device according to claim 2, wherein a first driving mechanism is provided for said guide mechanism and a second driving mechanism is provided for said knife carrier, the speed of said tubular cutting blade being controllable by means responsive to the wire tension.

9. The device according to claim 1, wherein said knife carrier has at least one radially extending arm, at a radially outer end of which is arranged said knife.

10. The device according to claim 1, wherein said knife carrier includes four radially extending arms arranged in a shape of a cross and having at a radially outer end of each thereof a said knife.

11. The device according to claim 1, wherein said tubular cutting blade includes a guiding element arranged between said guide mechanism and said cutting blade, said guiding element being rotatable with said tubular cutting blade and serving to receive wire from said guide mechanism and guide it toward said tubular cutting blade.

12. The device according to claim 1, wherein means are provided for electrically insulating the wire from said device.

13. The device according to claim 1, wherein a receiving apparatus is provided for receiving cut off wire segments therein, said receiving apparatus including a vibrator means for vibrating said receiving apparatus.

* * * * *

UNITED STATES PATENT AND TRADEMARK OFFICE

CERTIFICATE OF CORRECTION

PATENT NO. : 5 078 032

DATED : January 7, 1992

INVENTOR(S) : Hans-Juergen GERLACH

It is certified that error appears in the above-identified patent and that said Letters Patent is hereby corrected as shown below:

On the title page, item [30] change the Foreign Application Priority Data from "Aug. 8, 1987" to ---September 8, 1989---.

Signed and Sealed this

Twenty-fifth Day of May, 1993

*Attest:*

Michael K. Kirk

MICHAEL K. KIRK

*Attesting Officer*

*Acting Commissioner of Patents and Trademarks*